United States Patent [19]

Marzullo

[11] Patent Number: 4,897,145

[45] **Date of Patent: * Jan. 30, 1990**

[54] PIVOTED HAMMER/GATE BACK-UP ASSEMBLY FOR A BUCKLE CHUTE FOLDER EQUIPPED WITH A MOISTENING DEVICE

[75] Inventor: Joseph H. Marzullo, Danbury, Conn.

[73] Assignee: Pitney Bowes Inc., Stamford, Conn.

[ * ] Notice: The portion of the term of this patent subsequent to Jan. 24, 2006 has been disclaimed.

[21] Appl. No.: 222,490

[22] Filed: Jul. 21, 1988

[51] Int. Cl.[4] ..... B31F 1/00

[52] U.S. Cl. ..... 156/442.1; 156/227; 156/443; 156/578; 118/253; 118/681; 493/420; 493/421; 270/45

[58] Field of Search ..... 118/681, 253, 264, 266, 118/267; 493/420, 421; 156/442.1, 441.5, 227, 578

[56] References Cited

U.S. PATENT DOCUMENTS

| | | | |
|---|---|---|---|
| 662,196 | 11/1900 | Jenne | 118/253 |
| 946,963 | 1/1910 | Granger | 118/253 |
| 4,380,210 | 4/1983 | Auerbach | 118/253 |
| 4,799,989 | 1/1989 | Marzullo | 156/442.1 |

*Primary Examiner*—Michael W. Ball
*Assistant Examiner*—Jeff H. Aftergut
*Attorney, Agent, or Firm*—Charles R. Malandra, Jr.; Melvin J. Scolnick; David E. Pitchenik

[57] ABSTRACT

An apparatus for applying moisture to a flexible document containing water-activated adhesive includes a buckle chute having a pair of opposing plates defining a document path therebetween, a stopping bar situated between the opposing plates, and an adjustable plate slidably mounted on one of the opposing plates. A moistening assembly is secured to the adjustable plate situated adjacent to one of the buckle chute plates on one side of the document path. The moistening assembly includes a reservoir and a wick secured to the reservoir and extending toward the document path. A hammer/gate unit is pivotably mounted to the adjustable plate on the other side of the document path for engaging the wick and urging the document against the wick. The hammer/gate unit is pivotable between a position adjacent to the moistening assembly for moistening operation and a non-moistening position remote from the moistening assembly.

3 Claims, 4 Drawing Sheets

PIVOTED HAMMER/GATE BACK-UP ASSEMBLY FOR A BUCKLE CHUTE FOLDER EQUIPPED WITH A MOISTENING DEVICE

BACKGROUND OF THE INVENTION

The instant invention relates to a wick cartridge assembly which may be used for wetting document sheets passing thereover, and more particularly to such an assembly for wetting document sheets containing a water-activated adhesive.

Millions of business correspondence forms are utilized in commerce and the like, such as billing invoices, delivery notification, and the like. At the present time, multisheet business forms, some utilizing carbon paper or other means of duplication, are sold by manufacturers and delivered to the users. The forms are removed from their shipping container and inserted in a typewriter or printer which may be operated by a computer. The billing information or the like may be fed into a computer system which operates the typewriter or printer, to place the desired billing information on the forms. Each form may differ in its information, in that the typewriter or printer will insert a different customer with a different address, and a different billing amount (or other information) for each form.

In the above prior art systems, it is necessary for the forms to carry severable, lateral side strips having holes into which the pins of a form feeding sprocket fit, so that there is precise control of the position of the data entered onto the various layers of the business form, which is typically pre-printed. The pre-printed portions must, of course, be in precise registration with the material which is added by the computerized typewriter or printer.

After the desired information has been entered by the computerized typewriter or printer, the forms are manually severed from each other, and the side strips with holes are removed. The forms may then be placed in an envelope.

The amount of paper in the side strips generally constitutes approximately 10 percent of the entire paper used in the forms, and thus constitutes a significant waste of paper, since the side strips are discarded. Furthermore, a considerable amount of manual labor is necessary to remove the forms from the typewriter or printer, to separate the forms and insert them into envelopes. Additionally, a significant amount of waste and delay is encountered by the simple step of shipping the blank business forms to the processor, involving the added expense of packaging materials and shipping expenses.

In response to the foregoing problems, a process has been developed for the production of message-containing envelopes in which the message may differ. Because the lateral, removable, perforated portions for alignment are unnecessary, there is a substantial savings in paper. The end product of this process constitutes a sealed, addressed envelope, ready for mailing. Many of the processes utilized to form such envelopes are complex and require novel components and methods, which in many cases have proven commercially unreliable. Accordingly, the assignee of the instant invention in co-pending application Ser. No. 07/115,219 filed Oct. 30, 1987 now U.S. Pat. No. 4,799,989, in the name of Joseph H. Marzullo taught an apparatus for forming such envelopes from flexible sheets containing a water-activated adhesive which has the advantage that the apparatus is an addition to conventional buckle chute folding apparatus, and thus is easily and economically implemented.

However, the '219 invention does not provide for the moistening apparatus to be temporarily moved to a non-sealing position in which the folder may operate without sealing, nor does it provide for easy jam clearance. Thus, the instant invention overcomes these shortcomings of the '219 invention by providing a releasable moistening device that can be moved between sealing and non-sealing positions and which provides easy access for jam clearance.

SUMMARY OF THE INVENTION

Accordingly, the instant invention provides apparatus for applying moisture to a flexible document containing water-activated adhesive. The apparatus comprises:

A. a buckle chute having
   i. a pair of opposing plates defining a document path therebetween,
   ii. a stopping bar situated between said opposing plates,
   iii. an adjustable plate slidably mounted on one of said opposing plates;

B. a moistening assembly secured to said adjustable plate situated adjacent one of said buckle chute plates on one side of said document path, said moistening assembly including a reservoir and a wick secured to said reservoir and extending toward said document path; and C. a hammer/gate unit pivotably mounted to said adjustable plate on the other side of said document path for engaging said wick and urging said document against said wick, said hammer/gate unit being pivotable between a position adjacent said moistening assembly for moistening operation and non-moistening position remote from said moistening assembly.

DESCRIPTION OF THE PREFERRED EMBODIMENT

Figure 1:
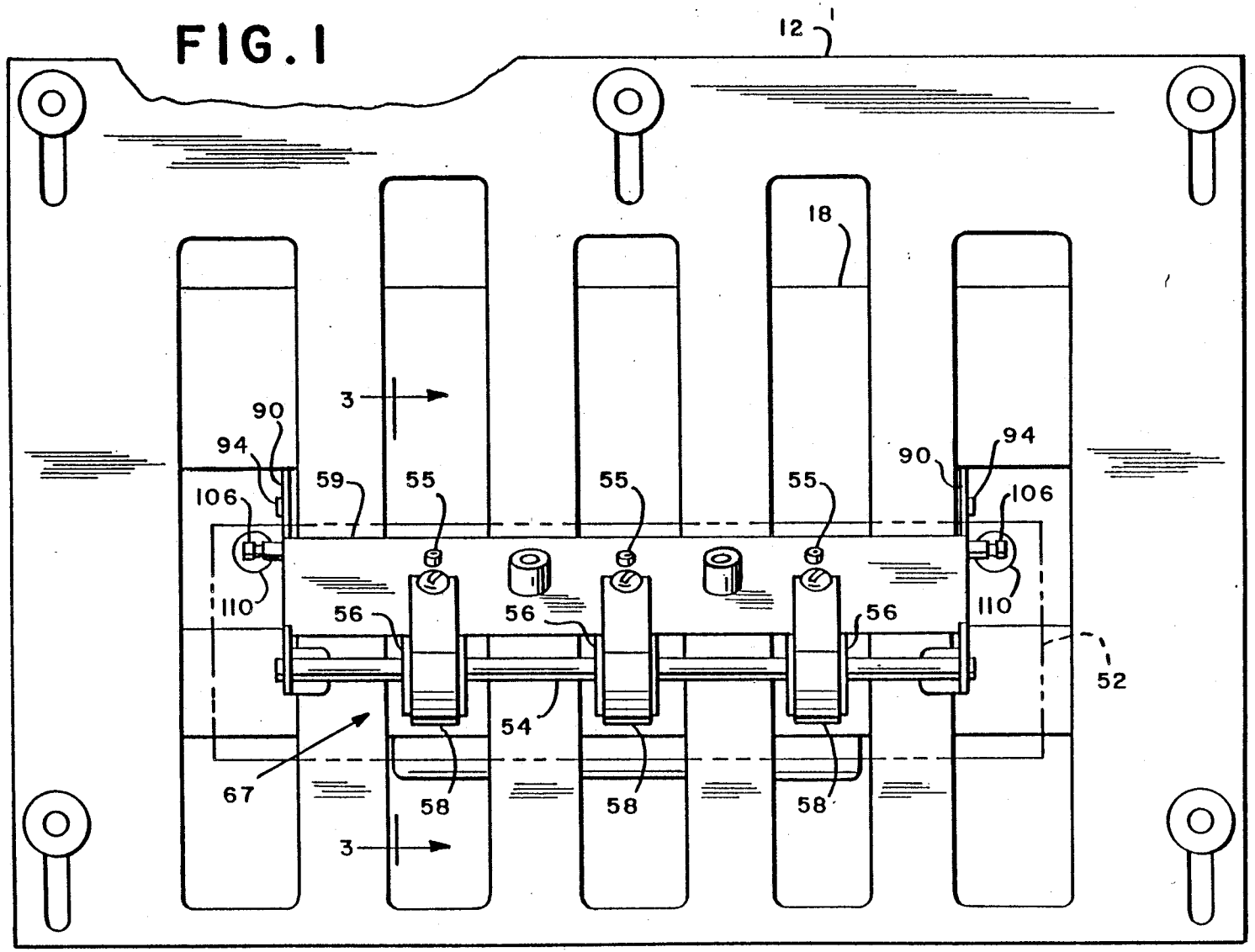
FIG. 1 is a front elevational view of a buckle chute folder having a moistening apparatus in accordance with the instant invention but with the moisture shield removed for clarity.
Figure 2:
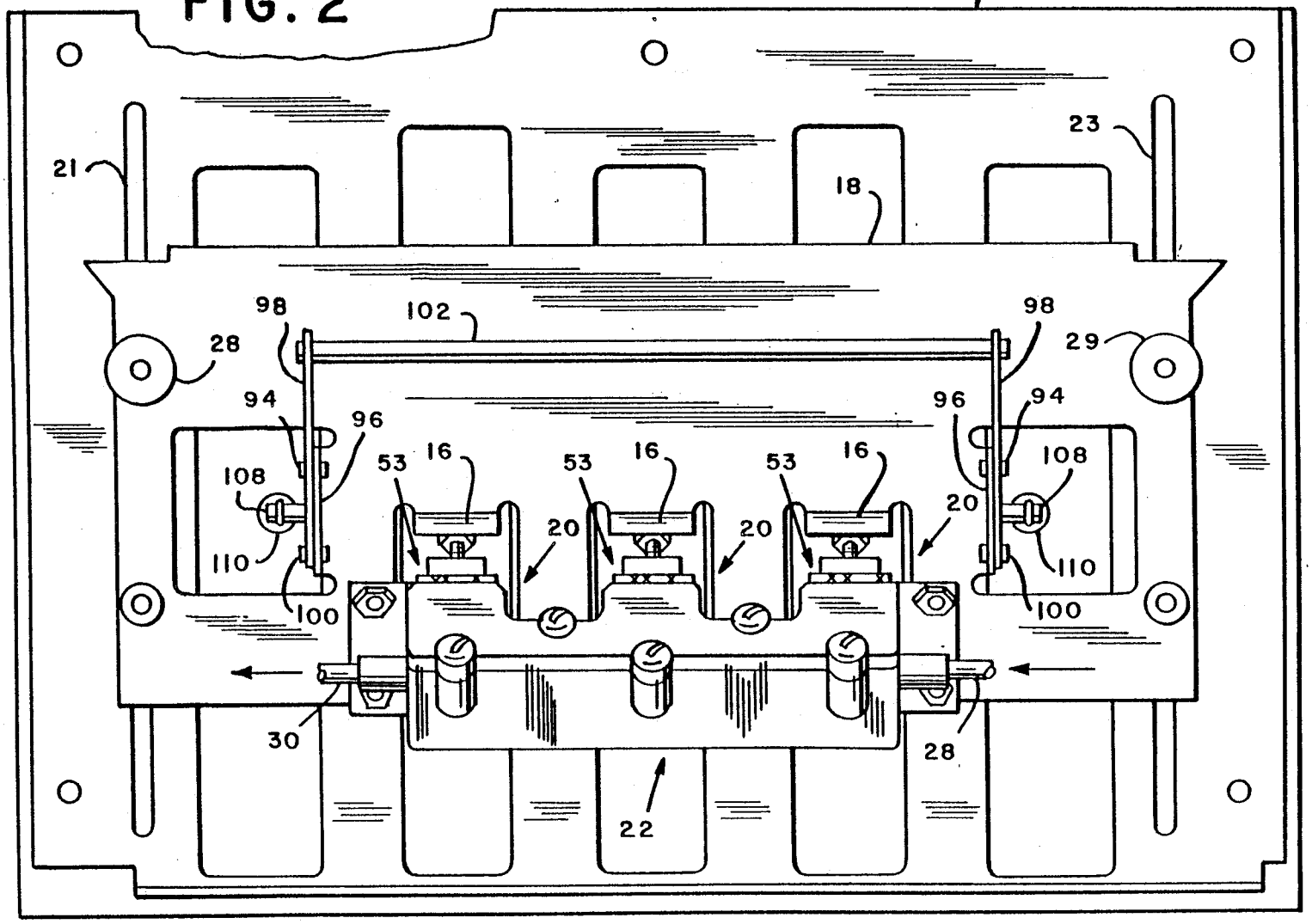
FIG. 2 is a rear elevational view of the apparatus seen in FIG. 1.
Figure 3:
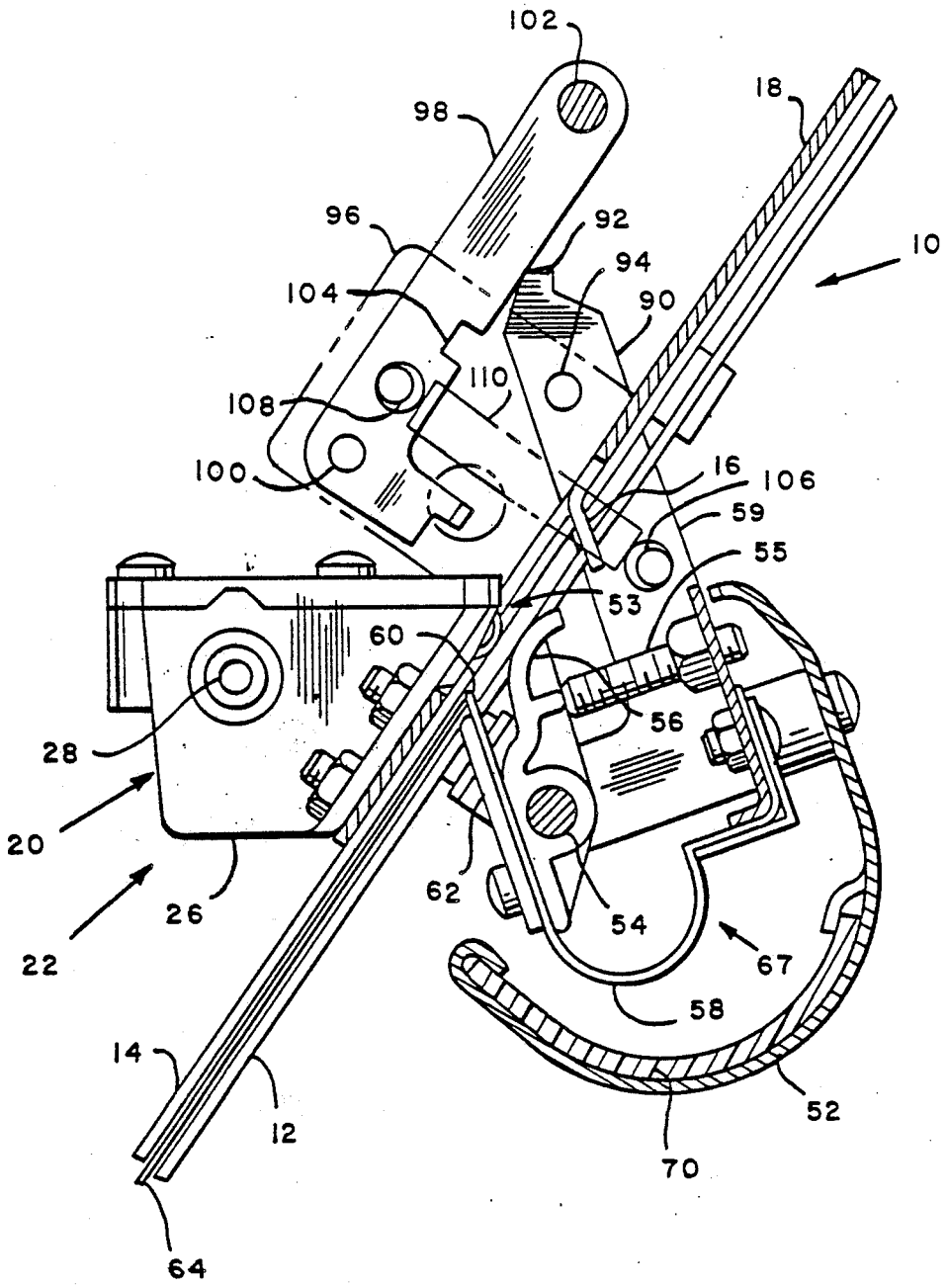
FIG. 3 is a sectional view substantially taken on the plane indicated by the line 3—3 in FIG. 1 but showing the moisture shield omitted in FIG. 1.

In describing the preferred embodiment of the instant invention, reference is made to the drawings, wherein there is seen in FIG. 3 a substantially vertically oriented buckle chute 10 consisting of a pair of opposing plates 12 and 14 with a space therebetween which defines a document path. The buckle chute 10 also includes an adjustable plate 18 (See FIG. 2) slidably mounted in slots 21 and 23 in the plate 14. The adjustable plate 18 also has three stopping bars 16 extending into the document path. The horizontal orientation of the stopping bars 16 can be adjusted by means of bolts 28 and 29 which move the sides of the adjustable plate 18 up or down. The bolts 28 and 29 engage the slots 21 and 23 respectively.

A moistening assembly 22 consisting of three moistening devices 20 is secured to the adjustable plate 18. The moistening assembly 22 includes three reservoirs 26 and an inlet port 28 and an outlet port 30 for water which is pumped into the reservoir 26 by a pump (not shown) from a large container of water. A moistening wick generally designated 53 extends from the reservoir 26 to the document path between the plates 12 and 14.

Across from the moistening assembly 20 on the other side of the plates 12 and 14 is a hammer/gate unit generally designated 67 consisting of three pivotable hammers 56 pivotably mounted on a shaft 54 and seating against three set screws 55. The shaft 54 is journalled in a frame 59 which is pivotably connected to the adjustable plate 18. A flexible, one-way gate 58 is secured to the lower portion of each of the hammers 56 for movement therewith. Each gate 58 includes an end portion 60 which extends into the document path. A gate deflector 62 is secured to the gate 58 and hammer 56 for movement therewith.

It is to be understood that the buckle chute 10 has associated with it (but not shown) a series of rollers which feed a document 64 up the buckle chute 10 and continue to feed the document 64 after it has reached the stopping bars 16 into another series of rollers which impart the desired fold to the document 64. Such rollers are conventional and their use with buckle chutes is well known. The moistening assembly 20 is used to apply moisture to a flexible document 64 which contains a water-activated adhesive on some portions thereof. The adhesive portions could be anywhere on the document, and typically in the case of a flexible document to be formed into a sealed envelope, would run along the sides of the document 64 and also comprise three areas on the interior of the document 64 and somewhat near the marginal edge portions. It can be seen in FIG. 2 that the embodiment shown therein is intended to apply moisture to three areas of the document 64 since three moistening wicks 53 are employed. It is possible to use one moistener 20 to wet just one area, or as many as desired for the particular document 64 being folded and sealed into an envelope. It should be understood that the moisture can be applied either to the areas containing the water-activated adhesive or to areas of the document 64 lacking such adhesive but which later are brought into contact with such adhesive-containing areas.

FIG. 3 shows the position of the hammer 56, gate 58 and deflector 62 when the document 64 enters the buckle chute 10. As the document is advanced up the buckle chute 10 by the appropriate feed rollers (not shown) the end 60 of the one-way gate 58 is deflected upward by the document 64. When the document 64 reaches the stopping bars 16, a buckle is created in an interior portion of the document 64 (not shown) as is well known and the document 64 continues to be fed resulting in the document 64 returning down the buckle chute 10. When the document 64 is being fed down the buckle chute 10, the gate portion 60 is engaged by the document 64 and bends around the gate deflector 62, which causes the hammer 56 to be pivoted clockwise and urges the document 64 firmly against the wick 53. Continued withdrawal of the document 64 from the buckle chute 10 wraps the gate 58 around the deflector 62 thereby developing even greater friction which in turn creates maximum force from the hammer 56 against the wick 53 and optimum water transfer from the wick 53 to the document 64.

Also attached to the pivotable frame 59 is a shroud 52 having a moisture absorbency lining 70 for absorbing any water which may leak from the adjacent apparatus. The pivotable frame 59 includes a pair of side flanges 90 which terminate in tongues 92. The flanges 90 pivot on pins 94 which are journalled in a pair of legs 96 which extend perpendicular from the adjustable plate 18. Also pivotably connected to the legs 96 are a pair of extension arms 98 which pivot on a pair of pins 100 which are also journalled in the pair of legs 96. The ends of the arms 98 are joined by a shaft 102 which functions as a handle to be discussed further hereinbelow. Each of the arms 98 includes a groove 104 which receives the tongues 92 of the flanges 90. The side flanges 90 include a pair of pins 106 and the arms 98 include a pair of pins 108. Each pin 106 is connected to each pin 108 by a spring 110 which biases the hammer/gate unit 67 in the sealing position seen in FIG. 3.

Figure 4:
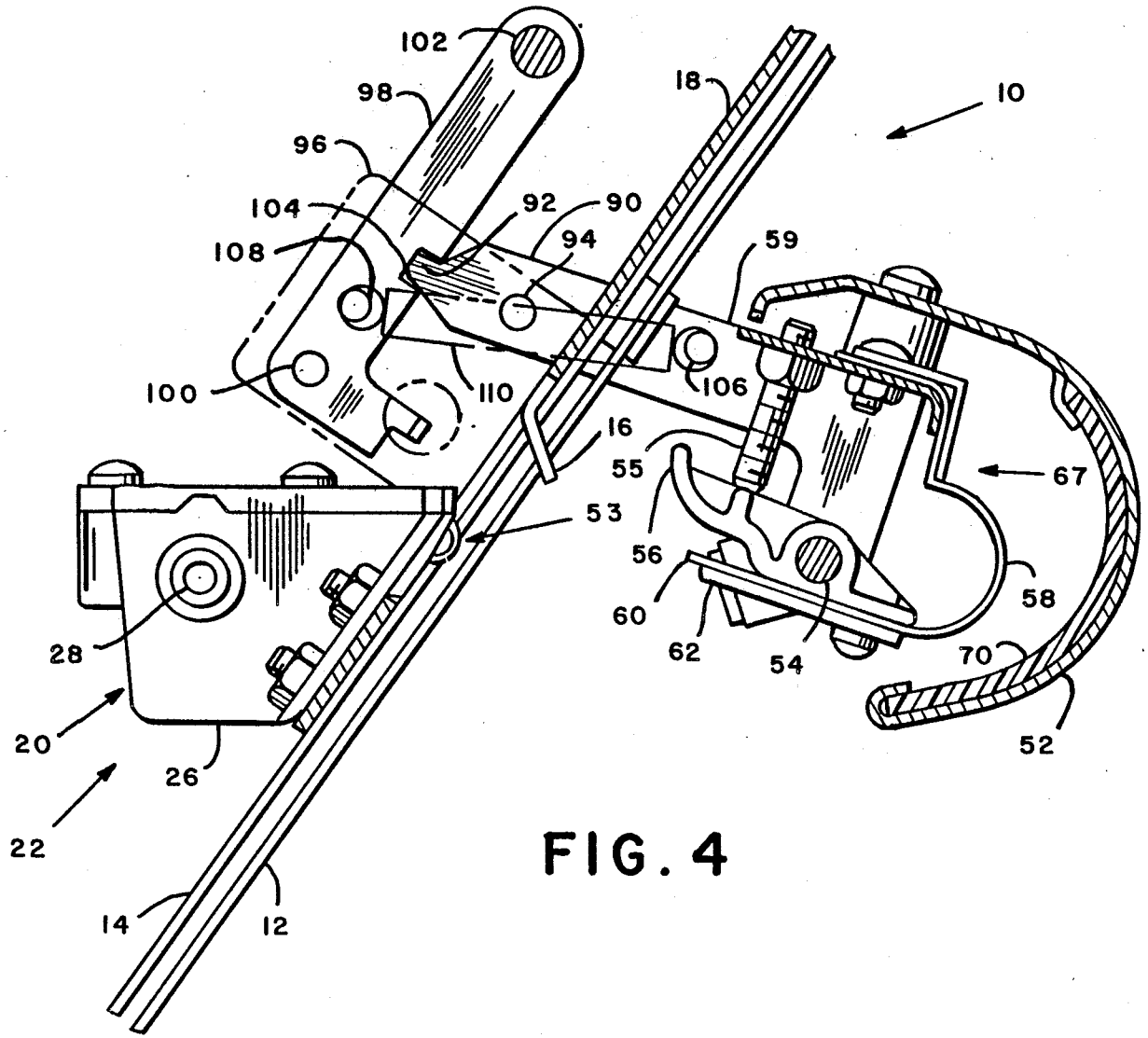
FIG. 4 is the identical to FIG. 3 but shows the moistening apparatus pivoted away from the buckle chute folder in a non-sealing position.

When it is desired to use the buckle chute 10 for folding and sealing a document into a sealed envelope, the hammer/gate unit 67 is biased into the alignment shown in FIG. 3. When it is desired to clear a jam or operate in a non-sealing mode, the operator of the buckle chute 10 merely grasps the shroud 52 and pivots the shroud 52 counterclockwise so that the tongues 92 engage the grooves 104 and the unit 67 is locked into the alignment seen in FIG. 4. In order to resume sealing operation, the operator merely grabs the handle/shaft 102 and pivots the handle 102 counterclockwise in order to release the tongues 92 from seating in the grooves 104. The action of the springs 110 then returns the unit 67 to the sealing position of FIG. 3.

It should be understood by those skilled in the art that various modifications may be made in the present invention without departing from the spirit and scope thereof, as described in the specification and defined in the appended claims.

What is claimed is:

1. Apparatus for applying moisture to a flexible document containing water-activated adhesive, comprising:

A. a buckle chute having
   i. a pair of opposing plates defining a document path therebetween,
   ii. a stopping bar situated between said opposing plates,
   iii. an adjustable plate slidably mounted on one of said opposing plates;

B. a moistening assembly secured to said adjustable plate situated adjacent one of said buckle chute plates on one side of said document path, said moistening assembly including a reservoir and a wick secured to said reservoir and extending toward said document path; and C. a hammer/gate unit pivotably mounted to said adjustable plate on the other side of said document path for engaging said wick and urging said document against said wick, said hammer/gate unit being pivotable between a position adjacent said moistening assembly for moistening operation and a non-moistening position remote from said moistening assembly.

2. The apparatus of claim 1, wherein said hammer/gate unit includes

A. a pivotable hammer pivotably mounted to said adjustable plate on the other side of said document path and extending toward the end of the wick extending to said document path, B. a flexible, one-way gate secured to the lower portion of said hammer for movement therewith, said gate having an end portion extending into said document path, and C. a gate deflector secured to said gate and lower hammer portion for movement therewith, wherein movement of a document up the buckle chute toward the stopping bar causes said gate to flex out of the document path and movement of a document down said buckle chute away from said stopping bar causes said gate to engage said document and bend around said gate deflector to thereby cause said hammer to pivot and urge said document against said wick, whereby moisture is applied to those portions of said document urged against said wick.

3. The apparatus of claim 2, wherein said hammer/-gate unit further includes a shroud operatively connected to said adjustable plate and movable with said hammer/gate unit.

* * * * *